US008265467B2

(12) United States Patent
Scott

(10) Patent No.: US 8,265,467 B2
(45) Date of Patent: Sep. 11, 2012

(54) LIGHT SUPPORT ASSEMBLY

(76) Inventor: Travis Lloyd Scott, Stuart, FL (US)

( * ) Notice: Subject to any disclaimer, the term of this patent is extended or adjusted under 35 U.S.C. 154(b) by 0 days.

(21) Appl. No.: 13/159,697

(22) Filed: Jun. 14, 2011

(65) Prior Publication Data

US 2011/0305028 A1 Dec. 15, 2011

Related U.S. Application Data

(60) Provisional application No. 61/354,658, filed on Jun. 14, 2010, provisional application No. 61/427,918, filed on Dec. 29, 2010.

(51) Int. Cl.
*F21V 21/00* (2006.01)

(52) U.S. Cl. ..... 392/398; 362/382; 362/249.01; 362/249.1

(58) Field of Classification Search ..... 362/190, 362/191, 238, 249.01, 249.02, 249.06, 249.11, 362/249.14–249.19, 285, 368, 382, 398, 362/457, 458
See application file for complete search history.

(56) References Cited

U.S. PATENT DOCUMENTS

| | | | | |
|---|---|---|---|---|
| 3,599,918 | A | 8/1971 | Patchett | |
| 4,714,219 | A | 12/1987 | Mayse | |
| 4,980,608 | A * | 12/1990 | Morrison | 315/185 S |
| D325,866 | S | 5/1992 | Gary | |
| D376,973 | S | 12/1996 | Brown | |
| 6,267,487 | B1 | 7/2001 | Tucker et al. | |
| 7,997,773 | B2 * | 8/2011 | Kraus et al. | 362/396 |
| 2006/0099370 | A1 | 5/2006 | Glass | |
| 2007/0175170 | A1 | 8/2007 | Shah | |

* cited by examiner

*Primary Examiner* — Hargobind S Sawhney
(74) *Attorney, Agent, or Firm* — Mattingly & Malur, PC

(57) ABSTRACT

A light support assembly includes a circular body having a slot at one end for receiving a light string therein which is secured by a cap at the one end. A magnet is mounted in a cavity at an opposite end of the body. An applicator holds the body during mounting of the light support assembly to a building or other structure.

7 Claims, 2 Drawing Sheets

LIGHT SUPPORT ASSEMBLY

BACKGROUND OF THE INVENTION

1. Field of the Invention

The present invention relates to a light support assembly for attaching temporary and portable lights in places such as on buildings and to supports on constructions sites.

2. Description of the Related Art

A number of devices such as hangers, brackets and the like are available for attaching temporary lights such as Christmas lights to buildings and for attaching other temporary lights such as lights used on construction sites. Many of these devices, however, suffer from the disadvantage that they are difficult to install and are not convenient for installing a string of lights.

SUMMARY OF THE INVENTION

It is an object of the present invention to provide a light support assembly which may be easily attached to a variety of structures such as eavestroughs, railings, temporary supports and the like.

Another object of the invention is to provide a light support assembly for attaching a string of lights to buildings and other support structures.

The present invention achieves the above and other objects by providing a light support assembly which includes a circular body having external threads at one end and a cavity at an opposite end. The one end has a central slot which is open at the top for receiving a light string therein. The assembly further includes a magnet mounted in the cavity at the opposite end of the body and an internally threaded circular cap which is screwed onto the one end to secure the light string therein.

The light support assembly further includes a circular metal plate having an adhesive layer on one side thereof whereby an opposite side of the metal plate magnetically adheres to the opposite end of the circular body.

The light support assembly further includes an applicator for holding the circular body and the circular cap, with the applicator including a holder body having a first opening at a first end which receives the circular body and the circular cap therein so that the circular cap is at a bottom of the first opening and the opposite end of the circular body containing the magnet, faces outwardly. The holder body has a second opening at a second end thereof and has a handle mounted in the second opening. The holder body also may have a hook on an outer surface thereof to aid in the removal of a light string after it has been mounted.

These, together with other objects and advantages which will be subsequently apparent, reside in the details of constructions and operation as more fully described in the claims hereafter, reference being made to the accompanying drawings forming a part hereof, wherein like numerals refer to like parts throughout.

DETAILED DESCRIPTION OF THE PREFERRED EMBODIMENTS

Figure 1:
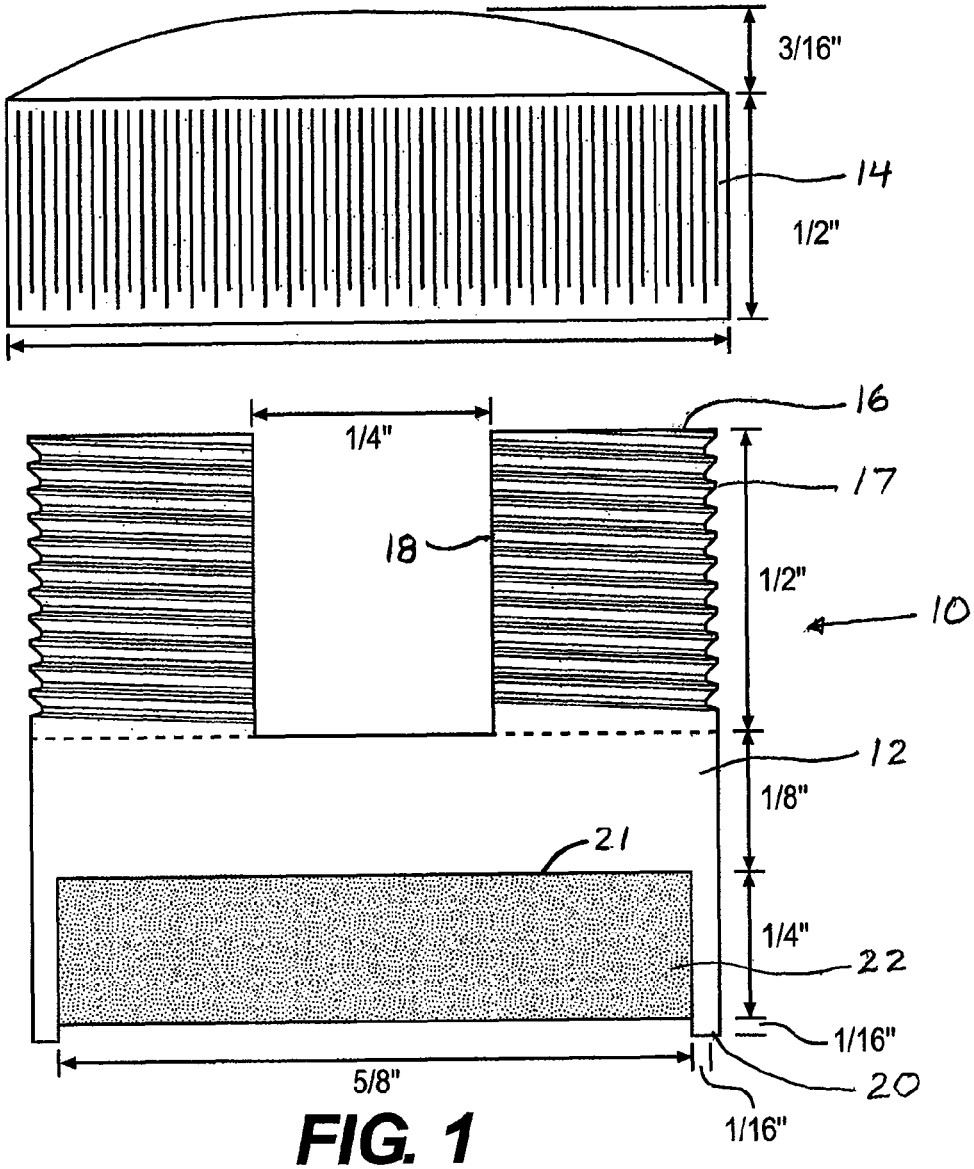
FIG. 1 is an exploded side view of a circular body having a magnet mounted therein at one end and having a circular cap which may be screwed onto the other end.

Referring to the drawings, a light support assembly, generally referred to by the numeral 10, is shown which includes a circular body 12 and a circular, semi-domed cap 14. The body and the cap preferably are made from a molded plastic material but other suitable materials such as metals may be used.

One end 16 of the circular body is provided with external threads 17 and an opposite end 20 of the body is provided with a cavity 21 for receiving a magnet 22 therein.

In the embodiment shown in FIG. 1, the magnet is positioned recessed into the opening 21 so that it is spaced upwardly a distance of approximately one sixteenth of an inch from the bottom of the circular body.

The circular body 12 is solid at the one end 16 and is provided with a slot 18 which extends across the end to receive a light string as described later. The cap 14 is internally threaded so that it may be screwed onto the thread 17 to secure a string of lights in the slot 18. The cap preferably is one half inch high in its main body portion and three sixteenths inch high in the semi-dome portion. the body has a threaded upper portion which preferably is one half inch high, a center portion which is one eighth inch high and a lower portion which is one fourth plus one sixteenth inch high. The slot 18 preferably is one fourth inch wide and the cavity 21 preferably is five eighths inch wide.

Figure 2:
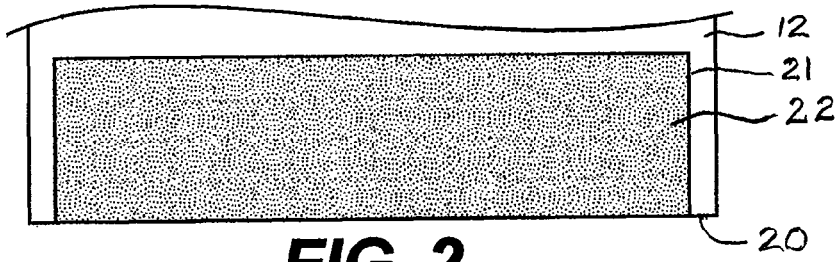
FIG. 2 is a partial side view of the bottom of the circular body showing a magnet which is flush with the bottom of the body.

A second embodiment of the invention is shown in FIG. 2, wherein the magnet 22 may be positioned in the cavity 21 so that the outer end of the magnet is flush with the end 20 of the circular body.

In the embodiments of both FIGS. 1 and 2, the light support assembly may be easily attached to a metal portion of a building such as an eavestrough by placing the magnet end of the circular body in contact with the metal surface so that the light support assembly is magnetically attached thereto.

Figure 3:
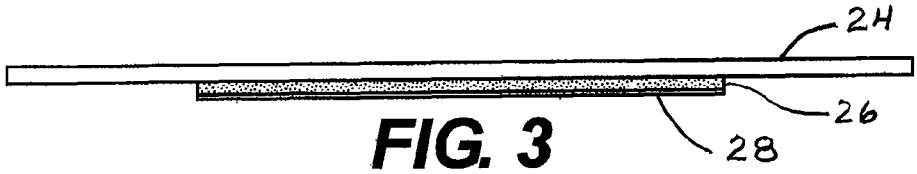
FIG. 3 is a side view of a metal plate having an adhesive layer on the bottom surface thereof covered by a removable protective layer.

In the event a building or other support structure does not have a metal surface, the light support assembly may be attached to the surface by the use of a metal circular plate 24 having an adhesive layer 26 attached to one surface thereof with the adhesive layer covered by a peel off layer 28 as shown in FIG. 3. The metal plate 24 may be magnetically adhered to the magnet at the end 20 of the circular body and the peel off layer 28 may then be removed and the adhesive layer pressed against the surface to easily attach the light support assembly to the surface.

Figure 4:
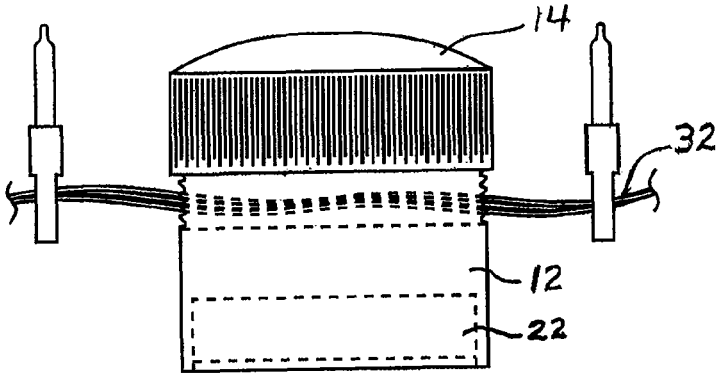
FIG. 4 is a side view of the circular body having a light string mounted therein.

As shown in FIG. 4, a light string 32 may be inserted into the slot 18 of the circular body and the cap 14 screwed onto the end 16 of the circular body to secure the light string to the light support assembly.

Figure 5:
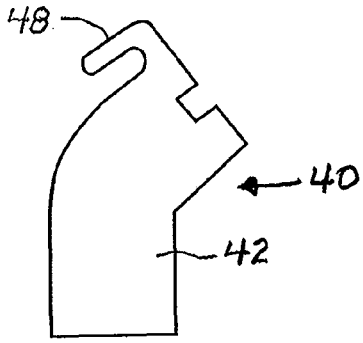
FIG. 5 is a side view of a holder body of an applicator for the circular body.
Figure 6:
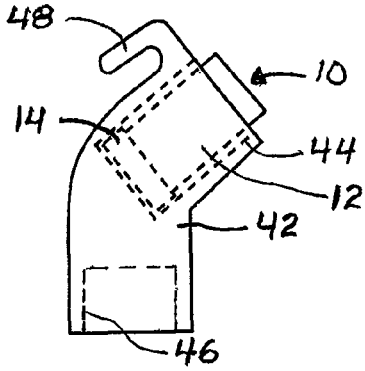
FIG. 6 is a side view of the holder body of the applicator showing the circular body of the light assembly with the cap screwed onto the inner end mounted in a hole in the holder body.
Figure 7:
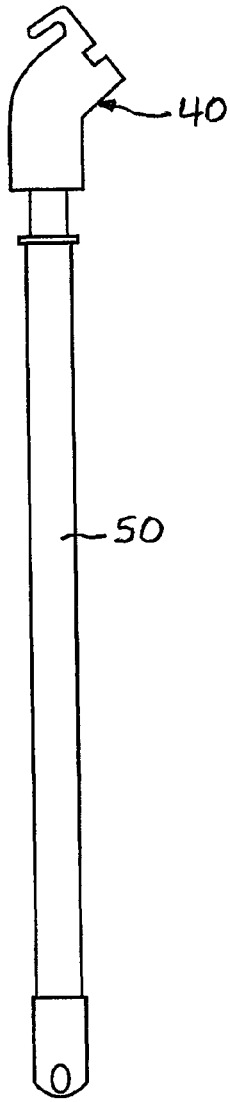
FIG. 7 is a side view of the holder body mounted on an end of a handle.

As shown in FIGS. 5-7, the light support assembly may also include an applicator 40 mounted on an extended handle 50 which may be used to mount each of the light support assemblies to a surface. The applicator 40 has a holder body 42 with a first opening 44 at one end and a second internally threaded opening 46 at an opposite end. As shown in FIG. 6 the body of light support assembly is inserted into the opening 44 at one end of the holder body 42 so that the cap 14 is at the inner end of the opening and the end of the body 12 containing the magnet 22 extends out from the opening 44.

The body may have a pair of aligned notches 45 at the top of the opening 44 so that the wires of the light string may be received therein when the body of a light support assembly holding a light string is in the holder body of the applicator. As shown in FIG. 7, a handle 50 such as that used on a broom and preferably having threads at one end is threaded into the opening 46 at the opposite end of the holder body 42 to secure the handle to the holder body. The handle also may be attached to the holder body by other suitable means such as a friction fit, gluing and fasteners.

In use of the light support assembly, where a plurality of the light support assembly bodies mounting a string of lights are to be attached to a building or other support structure, each light support assembly body is inserted one at a time into the holder body of the applicator and the body is moved by the applicator having the handle attached thereto so that the magnetic end of the body comes in contact with a metal surface of the building or other support structure. After a light support assembly body is magnetically attached, the applicator is simply withdrawn by lowering it with the handle. Another light support assembly body is then inserted into the applicator and this process is continued until an entire string of lights is mounted. In a case where no metal is available on a building or other support structure, the metal plate 24 is attached to the bottom 20 of the body and held there magnetically and the strip 28 is then peeled off to expose the adhesive layer 26. When the light support assembly body is then brought into contact with the building or other support structure, the light support assembly body is adhesively secured thereto.

The applicator 40 also may be provided with a hook 48 on an outer surface thereof. The hook is useful for aiding in the removal of each light support assembly body in that it may be used to grab the wire of the light string and pull on the wire to detach each light support assembly body. In use, the user rotates the handle 180 degrees and grab the wire of the light string with the hook so that the magnet or the adhesive layer of the first light support assembly body is detached from a building or other support structure and then the user proceeds to walk the length of the structure while holding the light strand until all the light support assembly bodies have been detached from the structure. This enables the string of lights to be detached without the use of a ladder.

Preferably the light support assembly body and cap is constructed of a plastic material by molding so that the opening, the slot and external threads are provided at one end of the body and a cavity is provided at an opposite end of the body. The applicator 40 also preferably is constructed of plastic so that the hook may be molded right onto the plastic body and the opening 44 is provided at one end and the threaded opening 46 at the opposite end of the holder body.

Also, marking means such as numbered or colored adhesive stickers may be provided so that when a plurality of light support assemblies are mounted in a desired pattern or order, the pattern or order may be easily followed or repeated when the light assemblies are taken down and put back up.

Numerous other modifications and adaptations of the present invention will be apparent to those skilled in the art and thus, it is intended by the following claims, to cover all such adaptations which fall within the true spirit and scope of the invention.

The invention claimed is:

1. A light support assembly comprising:

a circular body having external threads at one end and a cavity at an opposite end;

said body further having a central slot at said one end which is open at the top to receive a light string therein;

a magnet mounted in said cavity; and an internally threaded circular cap screwed on said one end to secure the light string therein.

2. The light support assembly according to claim 1 wherein said magnet is recessed upwardly from an outer end of said cavity.

3. The light support assembly according to claim 1 wherein said magnet is flush with an outer end of said cavity.

4. The light support assembly according to claim 1 which further comprises a circular metal plate having an adhesive layer on one side thereof whereby an opposite side of said metal plate magnetically adheres to said opposite end of said circular body.

5. The light support assembly according to claim 1 which further comprises an applicator for holding said circular body and said circular cap, said applicator comprising:

a holder body having a first opening at a first end which receives said circular body and said circular cap therein so that said circular cap is at a bottom of said first opening and said opposite end of said circular body containing said magnet faces outwardly and having a second opening at a second end; and a handle mounted in said second opening of said holder body.

6. The light support assembly according to claim 5 wherein said second opening is internally threaded and said handle is externally threaded at one end whereby by said handle is screwed into said second opening to attach said handle to said holder body.

7. The light support assembly according to claim 5 wherein said holder body includes a hook on an outer surface thereof.

* * * * *